US005300877A

United States Patent [19]

Tesch

[11] Patent Number: 5,300,877

[45] Date of Patent: Apr. 5, 1994

[54] PRECISION VOLTAGE REFERENCE CIRCUIT

[75] Inventor: Bruce J. Tesch, Melbourne, Fla.

[73] Assignee: Harris Corporation, Melbourne, Fla.

[21] Appl. No.: 904,848

[22] Filed: Jun. 26, 1992

[51] Int. Cl.[5] ..... G05F 3/16

[52] U.S. Cl. ..... 323/313; 323/907; 307/296.6

[58] Field of Search ..... 323/312, 313, 314, 315, 323/316, 317, 907; 307/296.1, 296.6, 296.7, 296.8

[56] References Cited

U.S. PATENT DOCUMENTS

| | | | |
|---|---|---|---|
| 4,249,122 | 2/1981 | Wildar | 323/313 |
| 4,375,596 | 3/1983 | Hoshi | 307/297 |
| 4,443,753 | 4/1984 | McGlinchey | 323/313 |
| 4,634,959 | 1/1987 | Boeckmann | 323/313 |
| 4,677,369 | 6/1987 | Bowers et al. | 323/314 |
| 4,868,416 | 9/1989 | Fitzpatrick et al. | 307/296.8 |
| 4,868,482 | 9/1989 | O'Shaughnessy et al. | 323/313 |
| 5,198,747 | 3/1993 | Haight | 323/303 |

*Primary Examiner*—Steven L. Stephan
*Assistant Examiner*—Adolf Berhane
*Attorney, Agent, or Firm*—Charles E. Wands

[57] ABSTRACT

A bridge-configured precision voltage reference circuit includes a first voltage supply terminal, a second voltage supply terminal, first and second bridge nodes, and a bridge resistor connected between the first and second bridge nodes. A Zener diode is coupled between the first bridge node and the first voltage supply terminal, and a voltage divider circuit is coupled between the first voltage supply terminal and the second bridge node. An output voltage terminal is coupled to the voltage divider circuit, so that a precision output voltage is derived as a fraction of the voltage differential between the second bridge node and the potential of the first voltage supply terminal. A fixed magnitude current source is coupled between the first bridge node and the second voltage supply terminal, and an adjustable current source is coupled between the second voltage supply terminal and the second bridge node. The adjustable current source supplies a bias current to the voltage divider circuit, so as to establish a prescribed voltage drop thereacross and thereby establish a precision output voltage. A temperature-compensating current supply circuit is coupled to the first and second nodes. At a first calibration temperature, parameters of the temperature-compensating current supply circuit, the adjustable current source and the voltage divider circuit are set such that such that there is no current flow through the bridge resistor and the output voltage is at the desired value. At a second calibration temperature, the value of the bridge resistor is adjusted such that there is a voltage drop across the bridge resistor, so that the output voltage is maintained at its intended value.

23 Claims, 7 Drawing Sheets

PRECISION VOLTAGE REFERENCE CIRCUIT

FIELD OF THE INVENTION

The present invention relates in general to signal processing circuits and is particularly directed to a new and improved precision voltage reference circuit, capable of producing a very stable output voltage in the presence of a substantial variation in operating temperature, with improved trim routine such that the output voltage trim and temperature coefficient trim are completely independent.

A variety of signal processing circuits require the use of a stable voltage reference circuit capable of providing an output voltage that remains constant over a wide range of ambient operating conditions, in particular changes in temperature. For this purpose, precision voltage reference circuits customarily employ a semiconductor voltage element such as a Zener diode as the primary building block or elementary component upon which the desired output voltage is based. This voltage is then temperature compensated and buffered by a precision operational amplifier to produce the voltage reference output.

The prior art circuit of FIG. 1 contains a Zener diode 1001 coupled between a precision ground reference 1003 and the cathode of a diode 1005. The anode of diode 1005 is coupled through a resistor 1007 to a feedback path 1009 from the output 1011 of an amplifier 1013, from which a voltage reference output is to be derived, via an output terminal 1015. The node 1021 between Zener diode 1001 and diode 1005 is coupled to the node 1023 of an adjustable resistor 1025 and a current source 1031. Current source 1031 is coupled to a V+ supply terminal 1033, which is coupled to amplifier 1013. Adjustable resistor 1025 is also coupled to a (+) input of amplifier 1013 and to a current source 1041. A noise control capacitor 1043 is coupled between ground and the (+) input of amplifier 1013. The node between adjustable resistor 1025 and current source 1041 is coupled to the (+) input of amplifier 1013. An input terminal 1051 is coupled to a (−) input of amplifier 1013 and through a resistor 1045 to a node 1053 between adjustable resistors 1055 and 1057, which are coupled in series between precision ground terminal 1003 and resistor 1007. A power ground terminal 1061 is coupled to amplifier 1013 and to through adjustable resistors 1063 and 1065 to amplifier 1013.

The prior art circuit of FIG. 2 contains a Zener diode 2001 coupled between ground 2003 and a bias resistor 2005, which is coupled in a feedback path 2007 from the output 2011 of an amplifier 2013, from which a voltage reference output is to be derived, via an output terminal 2015. The node 2021 between Zener diode 2001 and resistor 2005 is coupled to a noise control node 2023 and to the (+) input of amplifier 2013. Noise control node 2023 is coupled through an external capacitor 2025 to ground. A trim current source 2031 is coupled between ground 2003 and the emitter 2041 of an NPN transistor 2043. The collector 2045 of transistor 2043 is coupled to a bias rail 2047, while its base 2051 is coupled to a node between a pair of series coupled adjustable resistors 2061 and 2063. Series coupled adjustable resistors 2061 and 2063 are coupled between ground 2003 and the output 2011 of amplifier 2013. The emitter 2041 of transistor 2043 is coupled to the (−) input of amplifier 2013.

In each of the prior art circuits of FIGS. 1 and 2, the Zener diode is self-biased by the precision output voltage and trim resistors to allow adjustment of this voltage and the temperature coefficient. Typically, the output voltage is trimmed at some elevated temperature to the desired value and then the temperature coefficient is trimmed at room temperature until the output voltage returns to the desired value. The main drawback of the prior art is that the temperature coefficient trim affects the previously trimmed output voltage at the elevated temperature, thus producing an undesired temperature coefficient.

SUMMARY OF THE INVENTION

In accordance with the present invention, the above-described problem of temperature coefficient trim is effectively obviated by a new and improved precision voltage reference circuit in which the output voltage and temperature coefficient trims are entirely independent. Furthermore, the present invention dispenses with components, such as a precision operational amplifier, which is required to self-bias the Zener diode reference element in the prior art. Instead, the present invention uses a combination of current sources and resistive components interconnected in a bridge configuration, and the parameters of which can be readily trimmed to provide a precision output voltage, the value of which is entirely independent of the temperature coefficient trim. Furthermore, the absence of a precision operational amplifier, which is inherently bandwidth limited, allows the output to recover in much less time to its preset value after the circuit is subjected to an intense electromagnetic anomaly, such as a gamma radiation event. It must be noted that the absence of the precision operational amplifier in the present invention makes this circuit truly a voltage reference in that the output impedance is relatively high, in comparison with the prior art.

For this purpose, the bridge-configured voltage reference circuit of the present invention has an (output compensation) bridge resistor coupled in circuit between first and second nodes. A Zener diode is coupled between a first terminal, to which a first supply potential (e.g. ground potential) is applied, and the first node, while a voltage divider circuit is coupled between the first terminal and the second node. The output of the circuit is derived from an output terminal coupled to the voltage divider circuit, so that the output voltage is a fraction of the voltage at the second node. A first current source is coupled between a second terminal, to which a second supply potential (e.g. Vcc in the case of a bipolar-configured circuit) is applied, and the first node, while a second current source is coupled between the second terminal and the second node.

A temperature-compensating current supply circuit is coupled to the first and second nodes, and is operative to control the flow of current through the bridge resistor such that there is no current flow through the bridge resistor at a first calibration temperature, and such that there is a readily measurable current flow through the bridge resistor at a second calibration temperature. The value of the bridge resistor is trimmed such that the resulting voltage drop across the bridge resistor at the second calibration temperature causes the voltage derived at the output terminal to be maintained at the same voltage measurable at the output terminal at the first calibration temperature.

The temperature-compensating current supply circuit includes a first temperature-dependent current source which is coupled to the first node and a second temperature-dependent current source which is coupled to the second node. The first and second temperature-dependent current sources have respective temperature-dependent output current characteristics that are effectively complementary to one another. The first temperature-dependent current source is operative to supply current in a first direction relative to (into) the first node, while the second temperature-dependent current source is operative to supply current in a second direction relative to (out of) the second node. As a result, in response to a variation in the operating temperature of the circuit, current flow through the bridge resistor is adjusted by the first and second temperature-dependent current sources, so as to maintain a constant output voltage at the output terminal.

The first temperature-dependent current source comprises a first temperature-dependent current supply circuit and a first temperature-dependent current sink circuit coupled in series with each other between the first and second supply terminals. Each of the first temperature-dependent current supply circuit and the first temperature-dependent current sink circuit is coupled through a first, relatively low value (e.g. on the order of ten ohms) sense resistor to the first node.

The second temperature-dependent current source comprises a second temperature-dependent current supply circuit and a second temperature-dependent current sink circuit coupled in series with each other between the first and second supply terminals. Each of the second temperature-dependent current supply circuit and the second temperature-dependent current sink circuit is coupled through a second, relatively low value sense resistor to the second node.

The temperature-coefficient of the first temperature-dependent current source effectively matches that of the second temperature-dependent current sink circuit; also, the temperature-coefficient of the first temperature-dependent current sink effectively matches that of the second temperature-dependent current source. The magnitudes of the temperature coefficients of complementary pairs of current source and sink circuits at the two nodes of the bridge circuit ensure that changes in their currents with temperature will result in a readily measurable voltage drop across the sense resistors, so as to facilitate trimming of circuit components during calibration.

DETAILED DESCRIPTION OF THE DRAWINGS

DETAILED DESCRIPTION

As described previously, the precision voltage reference circuit of the present invention eliminates the problem of output voltage trim and temperature coefficient trim interdependence. A significant advantage of the detailed circuit embodiment is that the precision output voltage is maintained to within ±0.1% after neutron irradiation at a level of $1\times10^{14}$n/cm$^2$.

Figure 3:
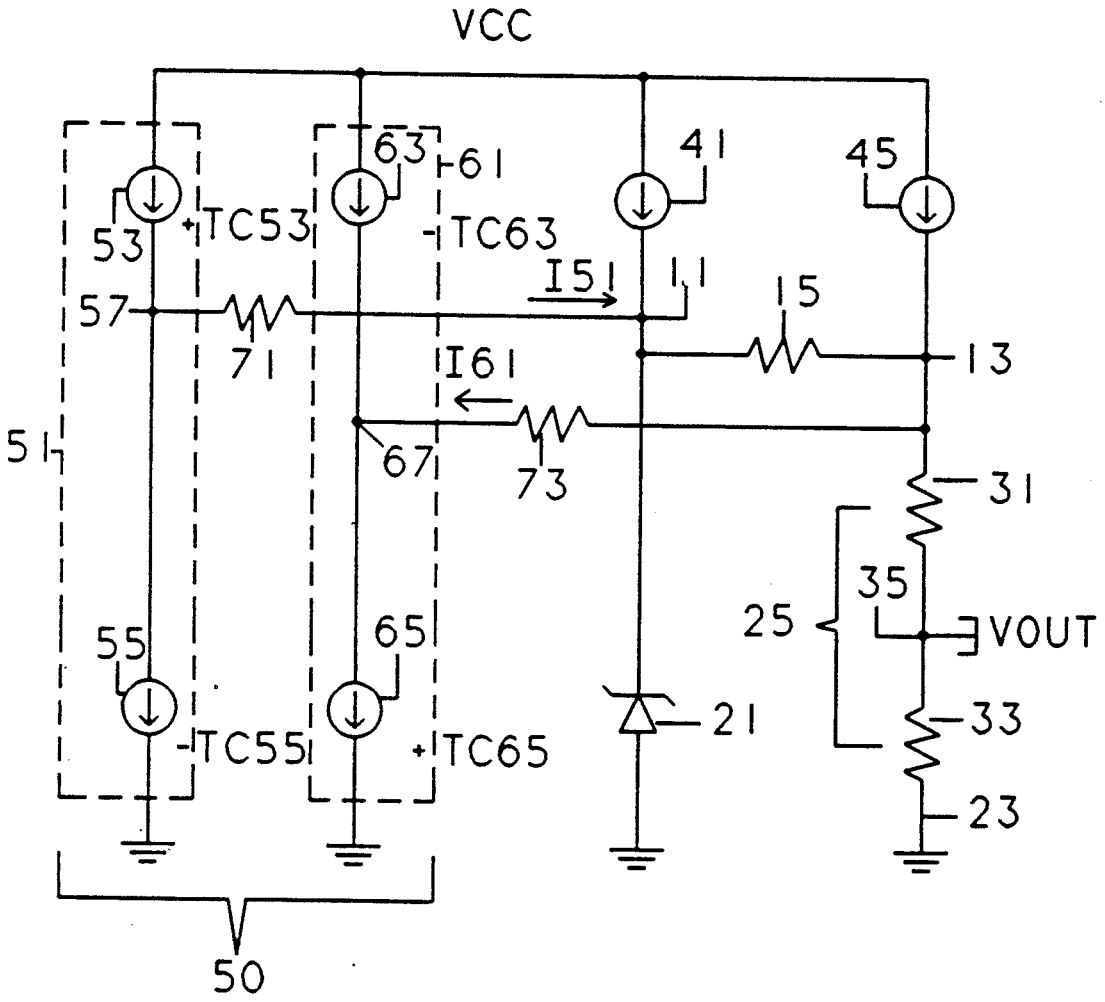
FIG. 3 is a reduced complexity schematic diagram of a precision voltage reference circuit in accordance with the present invention.

Referring to FIG. 3, a reduced complexity schematic diagram of the Zener diode-referenced, bridge-configured, precision voltage circuit in accordance with the present invention is shown as comprising a first bridge node 11 and a second bridge node 13, between which an (output compensation) bridge resistor 15 is connected. A Zener diode 21 is coupled between first bridge node 11 and a first supply potential terminal 23, to which a first supply potential (e.g. ground potential GND) is applied. A voltage divider circuit 25, comprised of series-connected resistors 31 and 33, is coupled between the first supply potential terminal 23 and the second bridge node 13. A precision output voltage Vout is derived from an output terminal 35, which is coupled to the common connection of series-connected resistors 31 and 33 of voltage divider circuit 25, so that the output voltage Vout is a fraction of the voltage differential between the second bridge node 13 and the ground potential of terminal 23.

A first fixed magnitude current source 41 is coupled between the first node 11 and a second terminal 43, to which a second supply potential (e.g. Vcc in the case of a bipolar-configured circuit) is applied. A second, trimable current source 45 is coupled between the second terminal 43 and bridge node 13. Trimable current source 45 supplies a bias current to the voltage divider circuit 25, so as to establish a prescribed voltage drop across resistors 31 and 33, and thereby establish the value of the precision output voltage Vout.

A temperature-compensating current supply circuit 50 is coupled to the first and second nodes 11 and 13, respectively, and is operative to control the flow of current through bridge resistor 15, such that there is no current flow through bridge resistor 15 at a first calibration temperature (e.g. room temperature or 25° C.), and such that there is a readily measurable current flow through bridge resistor 15 at a second, (elevated) calibration temperature (e.g. on the order of 75° C.). As will be described below, the value of bridge resistor 15 is trimmed after the operating temperature of the circuit has been elevated from room temperature to the second calibration temperature, such that the resulting voltage drop across bridge resistor 15, at the second calibration temperature, causes the voltage derived at output terminal 35 to be maintained at the same voltage Vout that has been preset at the first calibration temperature.

Temperature-compensating current supply circuit 50 includes a first temperature-dependent current source 51, which is coupled to node 11, and a second temperature-dependent current source 61, which is coupled to node 13. Temperature-dependent current sources 51 and 61 have respective temperature-dependent output current characteristics that are effectively complementary to one another, such that current injected by one current source into a node at one end of the bridge will be sinked from the other node at the opposite end of the bridge into the other current source. Namely, temperature-dependent current source 51 is operative to supply current I51 in a first direction (into) relative to node 11, while temperature-dependent current source 61 supplies current I61 in a second direction (away from relative to node 13 as a function of increasing temperature. As a result, as will be explained in detail below, in response to a variation in the operating temperature of the precision voltage circuit, current flow through bridge resistor 15 is adjusted by temperature-dependent current sources 51 and 61, so as to maintain a constant output voltage at output terminal 35.

Figure 1:
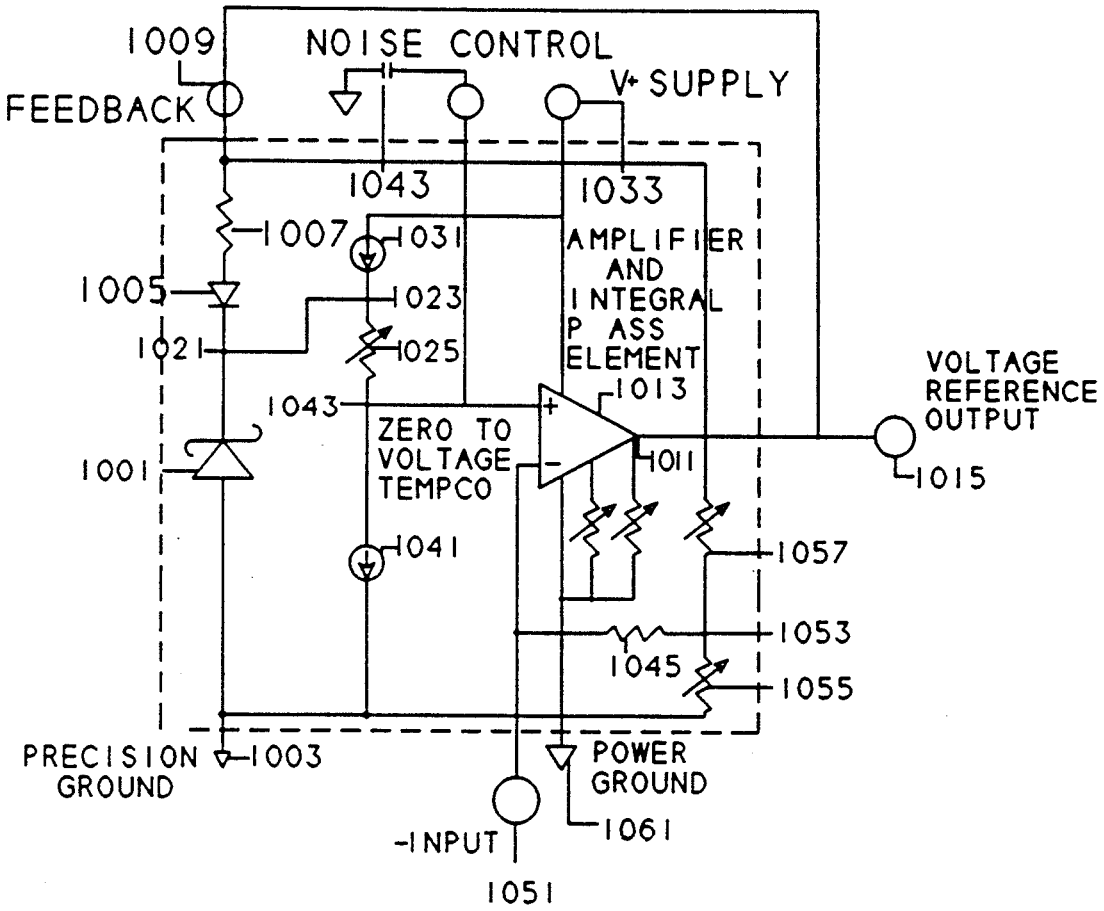
FIG. 1 (PRIOR ART)
FIGS. 1 and 2 are illustrations of respective prior art voltage reference circuits having Zener diodes that are self-biased by a precision output voltage and trim resistors to allow adjustment of voltage and temperature coefficient.
Figure 2:
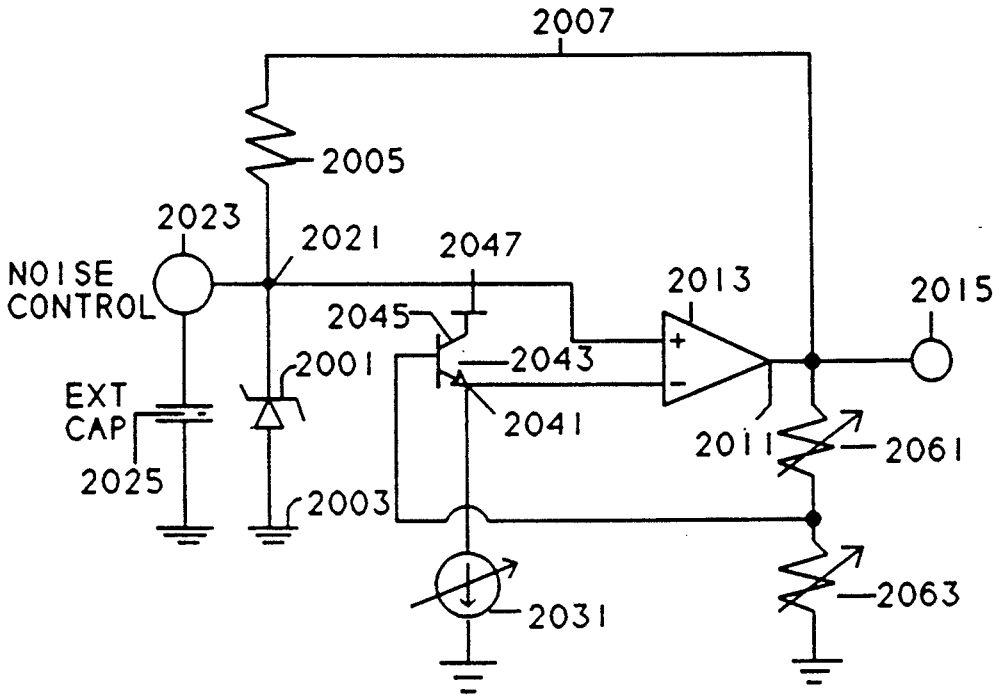
FIG. 2 (PRIOR ART)

Temperature-dependent current source 51 comprises a first temperature-dependent current supply circuit 53 (a schematic diagram of which is presented in FIG. 2) and a first temperature-dependent current sink circuit 55 (a schematic diagram of which is presented in FIG. 3) coupled in series with each other between supply terminals 23 and 43. Each output of temperature-dependent current supply circuit 53 and temperature-dependent current sink circuit 55 is coupled at a probe node 57 through a first, relatively low value (e.g. on the order of ten ohms) sense resistor 71 to bridge node 11. Similarly, temperature-dependent current source 61 comprises a second temperature-dependent current supply circuit 63 (a schematic diagram of which is presented in FIG. 4) and a temperature-dependent current sink circuit 65 (a schematic diagram of which is presented in FIG. 5) coupled in series between supply terminals 23 and 43. Each output of temperature-dependent current supply circuit 63 and temperature-dependent current sink circuit 65 is coupled at a probe node 67 through a second, relatively low value sense resistor 73 to bridge node 13.

Temperature-dependent current source 53 has a positive temperature-coefficient +TC53 that effectively matches the positive temperature-coefficient +TC65 of temperature-dependent current sink circuit 65. Similarly, temperature-dependent current sink 55 has a negative temperature-coefficient −TC55 that effectively matches the negative temperature-coefficient −TC63 of temperature-dependent current source 63. The magnitudes of the temperature coefficients of the complementary, series-connected pairs of current source and sink circuits 53–55 and 63–65 at the opposite nodes 11 and 13 of bridge resistor 15 ensures that temperature-induced changes in currents I51 and I61 will be sufficiently large (e.g. on the order of ten microamps per degree centigrade) to yield a voltage equal and opposite to the Zener voltage temperature coefficient (e.g. 1–2mv/° C.) with a value of resistor 15 in the range of 100–200 ohms. Resistors 71 and 73 are provided to trim current sources 53–55 and 63–65 such that I51 and I61 are both zero at the first (25° C.) trim temperature.

Figure 4:
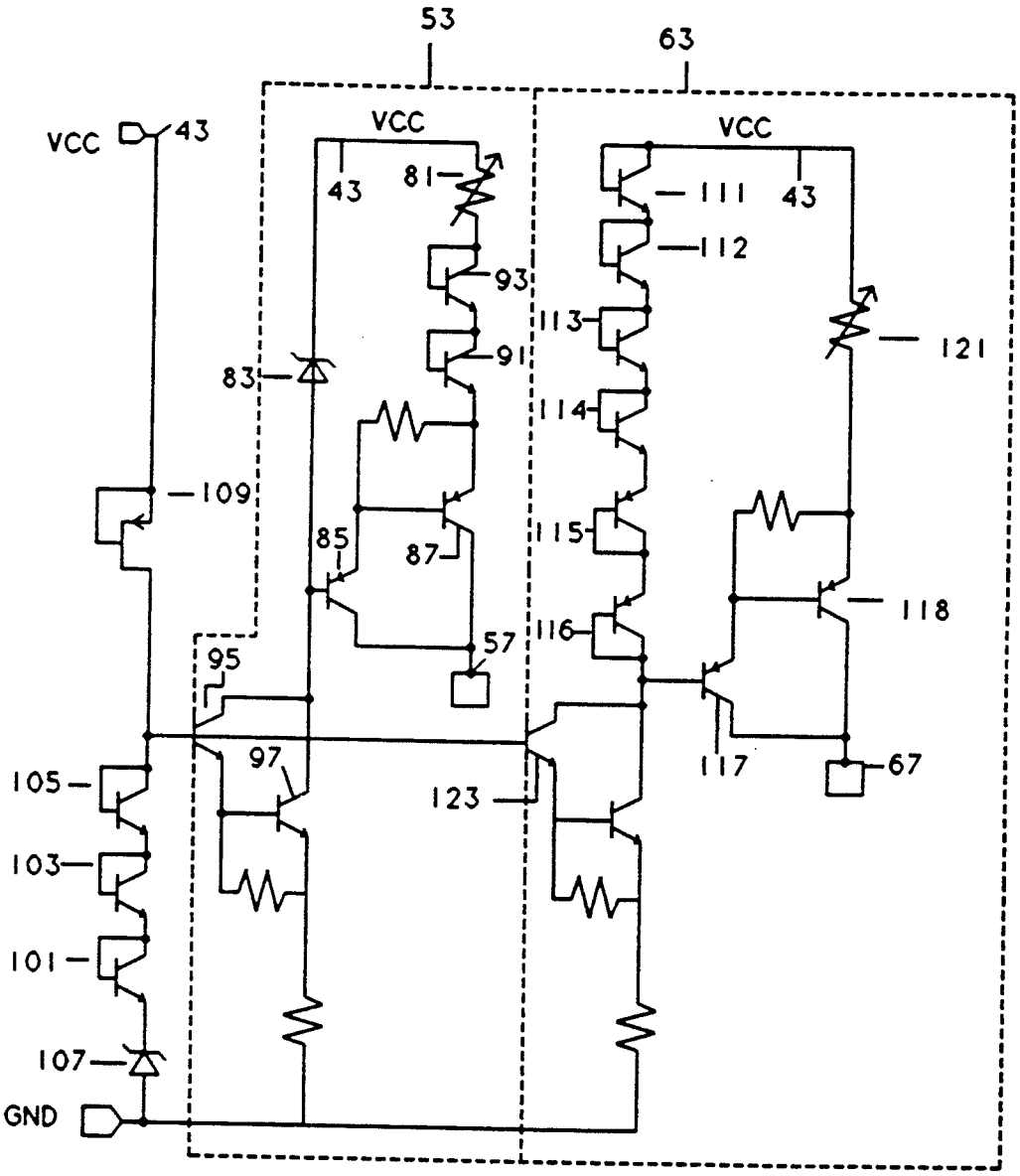
FIG. 4 is a detailed schematic diagram of the first and second temperature-dependent current supply circuits.

As shown schematically in FIG. 4, temperature-dependent current supply circuit 53 achieves its positive temperature-coefficient +TC53 by means of the temperature dependency of a series of PN junctions referenced to the second potential supply terminal 43 (Vcc) and coupled across a control resistor 81. Specifically, a Zener diode 83 has its cathode connected to the Vcc supply terminal 43 and its anode coupled to the base of a Darlington pair of bipolar transistors 85, 87. The emitter of transistor 87 is coupled in cascade with diode-connected transistors 91, 93 to control resistor 81. The base-emitter junctions of transistors 85, 87, 91, 93 are effectively connected in series with one another and each has a temperature-dependent voltage variation on the order of −2mV/° C. Zener diode 83 has a positive temperature-dependent voltage variation on the order of +2mv/° C. so that, across control resistor 81 there is an effective temperature-dependent voltage variation on the order of +10mV/° C. corresponding to +TC53. The current output of current source 53 is derived at probe node 57.

The base current drive for Darlington pair 85, 87 is obtained from Darlington transistor pair 95, 97, the base bias for which is obtained through a series of diode connected bipolar (NPN) transistors 101, 103, 105 referenced to a Zener diode 107 and coupled to Vcc through JFET 109 operating at IDSS. The Vbe of transistor 101 provides approximate temperature compensation for Zener diode reference 107, while the Vbe's of diodes 103, 105 provide temperature compensation for Darlington pair 95, 97.

Also schematically shown in FIG. 4 is temperature-dependent current supply circuit 63, which achieves its negative temperature-coefficient −TC63 by means of the temperature dependency of a series of PN junctions of diode connected transistors 111–118 referenced to the second potential supply terminal 43 (Vcc) and coupled across a control resistor 121. Series-coupled diodes 111–116 are coupled to the base of a Darlington pair of bipolar transistors 117, 118. The emitter of transistor 118 is coupled to control resistor 121. Each of the base-emitter junctions of diode-connected transistors 111–116 has a temperature-dependent voltage variation on the order of −2mV/° C., so that, with the subtraction of the temperature coefficients of Darlington pair 117, 118, the resultant temperature-dependent voltage variation across control resistor 121 is on the order of −8mV/° C. The base current drive for Darlington pair 116, 117 is obtained from Darlington transistor pair 123, 125, the base bias for which is connected in common with that of Darlington pair 95, 97. The current output of current source 63 is derived at probe node 67.

As pointed out above, the positive temperature-coefficient +TC53 of temperature-dependent current source 53, schematically shown in FIG. 4, effectively matches the positive temperature-coefficient +TC65 of temperature-dependent current sink circuit 65. Similarly, the negative temperature-coefficient −TC55 of temperature-dependent current sink 55 of FIG. 5 effectively matches the negative temperature-coefficient −TC63 of temperature-dependent current source 63. Thus, in the schematic illustration of FIG. 5, current sinks 55 and 65 are configured of the same components of FIG. 2, but arranged in a complementary circuit connection direction between GND and Vcc. Since the two pairs of circuits are otherwise the same, no further description will be given here. Suffice it to say that current sink 55 has an effective temperature-dependent voltage variation on the order of −8mV/° C. corresponding to −TC55, and the current input of current source 55 is derived at probe node 57. Also, current sink 65 has an effective temperature-dependent voltage variation on the order of +10mV/° C., corresponding to +TC65. The current input of current sink 65 is derived at probe node 67.

Figure 6:
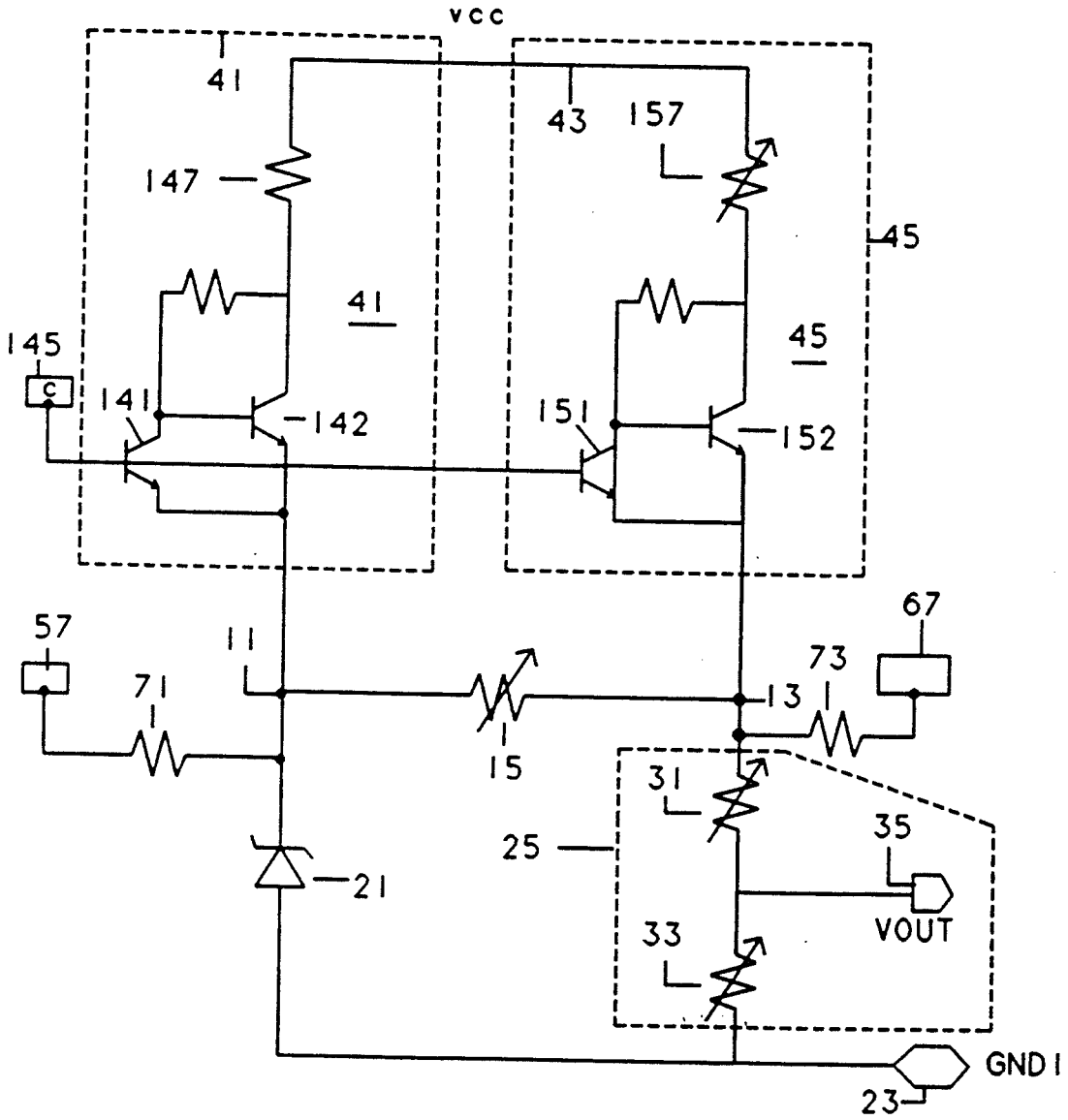
FIG. 6 is a detailed schematic diagram of the interconnection of the Zener diode bridge portion of the precision voltage reference circuit of FIG. 3.

FIG. 6 shows, in greater detail, the Zener diode-referenced bridge portion of the precision voltage reference circuit diagrammatically illustrated in FIG. 3, described previously. First bridge node 11 and a second bridge node 13, between which bridge resistor 15 is connected, are respectively coupled to sense resistors 71 and 73. Zener diode 21 is coupled between bridge node 11 and first supply potential terminal 23, to which a first supply potential (e.g. ground potential GND) is applied. Voltage divider circuit 25 is comprised of series-connected variable resistors 31 and 33 and is coupled between the first supply potential terminal 23 and the second bridge node 13. An output terminal 35, from which a precision output voltage Vout is derived, is coupled to the common connection of series-connected resistors 31 and 33 of voltage divider circuit 25, so that the output voltage Vout is a fraction of the voltage differential between the second bridge node 13 and the ground potential of terminal 23.

Figure 5:
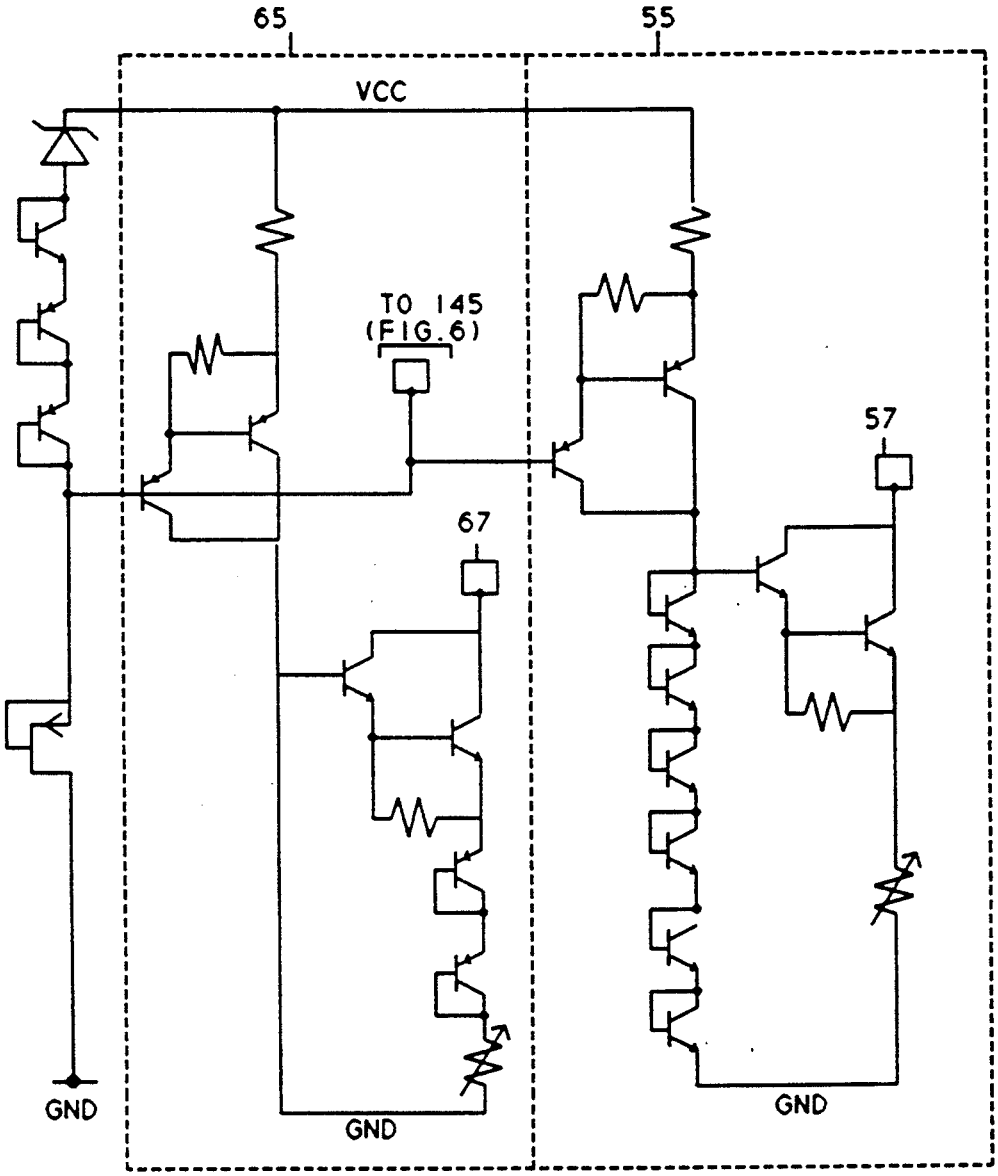
FIG. 5 is a detailed schematic diagram of the first and second temperature-dependent current sinks.

Fixed magnitude current source 41 is comprised of a Darlington pair of transistors 141, 142, the base drive for which is derived from node 145, which supplies the base drive for the current sinks 55 and 65, shown in schematic detail in FIG. 5. The magnitude of current source 41 is set by resistor 147, coupled to Vcc terminal 43. Trimable current source 45 is coupled between Vcc terminal 43 and bridge node 13. Trimable current source 45 also comprises a Darlington transistor pair 151, 152, the base drive for which is coupled to node 145. Current source 45 includes a trim resistor 157, coupled between Darlington pair 151, 152 and Vcc terminal 43 for establishing the magnitude of an adjustable current to the voltage divider circuit 25, and thereby establish the voltage drop across resistors 31 and 33.

OPERATION

As described briefly above, the parameters of the precision voltage reference circuit of the present invention are readily trimmed independently of one another for first and second calibration temperatures. During calibration, in addition to monitoring the output voltage Vout at output terminal 35, the voltage across sense resistors 71 and 73 is monitored by way of bridge nodes 11 and 13 and probe nodes 57 and 67.

ROOM TEMPERATURE CALIBRATION

Calibration at room temperature (e.g. on the order of 25° C.) sets the output voltage Vout at the desired value such that there is no current flow through bridge resistor 15. With the Zener diode bias current as supplied by current source 41 fixed, the values of the control resistors (81 and 121) of the current supply 53 and 63 and those of current sinks 55 and 65 are adjusted such that the output of current source 53 is equal to the current sunk by current sink 55, and such that the output of current source 63 is equal to the current sunk by current sink 65. This current flow balance is achieved when the voltage drops across sense resistors 71 and 73 are zero, indicating no current is being supplied to bridge nodes 11 and 13 from temperature-compensating current supply circuit 50.

The values of resistors 157, 31 and 33 of the diode bridge circuit are iteratively trimmed, so as to adjust the magnitude of the current supplied by current source 45 and the output voltage Vout, such that Vout is equal to the target voltage Vref of the precision voltage reference circuit and such that there is no current flow through bridge resistor 15. It should be noted that since room temperature calibration serves to establish no current flow through bridge resistor 15, the magnitude of the output voltage Vout is initially calibrated to be independent of the value of the bridge resistor.

ELEVATED TEMPERATURE CALIBRATION

Calibration at an elevated temperature (e.g. on the order of 75° C.) involves adjusting the value of bridge resistor 15 to offset the change in Zener voltage of diode 21 resulting from the increase in temperature. At the elevated calibration temperature there is a substantial current flow (e.g. on the order of 500 microamps) injected into bridge node 11 and extracted from bridge node 13 due to the opposing temperature coefficients of current source/sink pair 53/55 and the opposing temperature coefficients of current source/sink pair 63/65. Namely, for an increase in temperature, each of current source 53 and current sink 55 will contribute to the injection of current into bridge node 11, while each of current source 63 and current sink 65 will contribute to removal of current from bridge node 13. This increase in current flow results in a substantial voltage drop across bridge resistor 15, so that the total voltage drop across the series connection of resistors 15-31-33, which are referenced to the Zener voltage Vz of Zener diode 21, is now affected by the voltage drop across bridge resistor 15. The value of bridge resistor 15 is trimmed until Vout once again equals Vref. When the operating temperature of the circuit again returns to room temperature, the output voltage Vout remains at Vref, since there is no current flow through bridge resistor 15 at room temperature, so that the trimming of the value of bridge resistor 15 at the elevated temperature does not affect circuit operation at room temperature. Thus, each calibration trim operation is independent of the other, assuring a precision output voltage over the range of the calibration (e.g. 25–75° C.).

Figure 7:
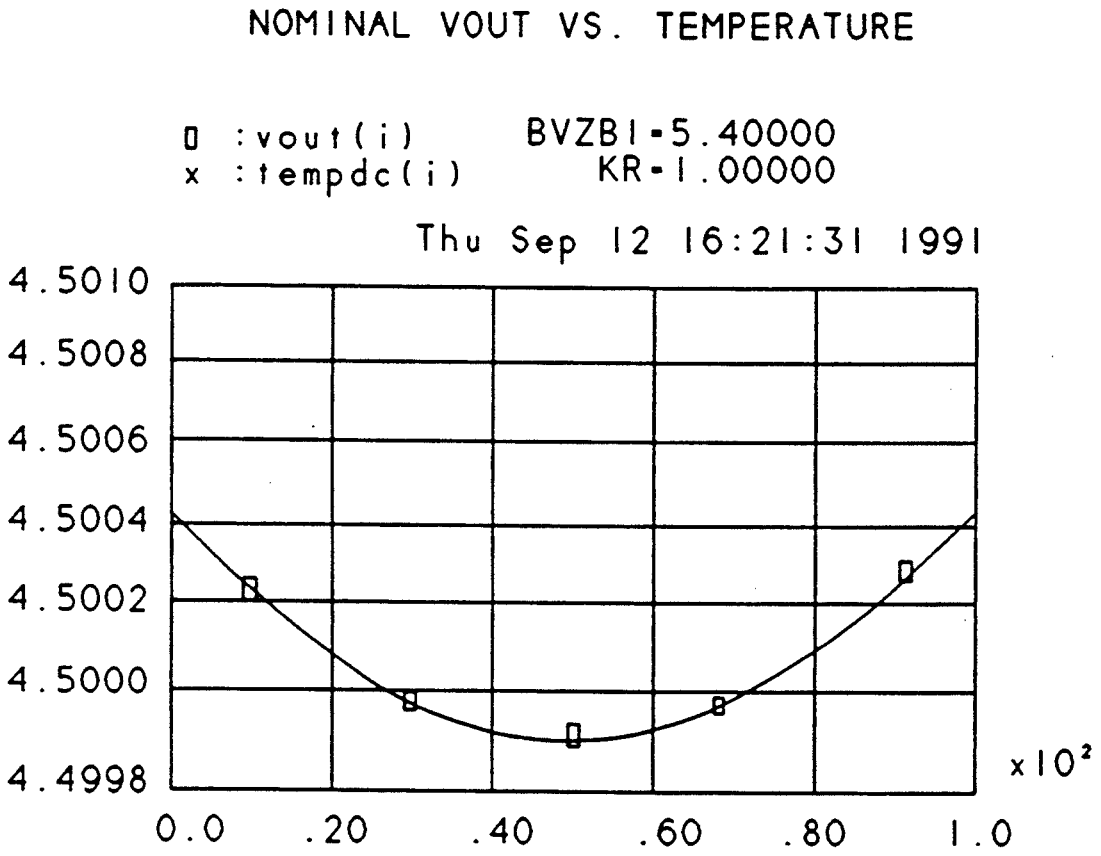
FIG. 7 is an output voltage vs. temperature plot in which the circuit of the present invention has been trimmed to an output voltage of 4.5V at 25° C. and 75° C. and simulated over a range 0° C. to 100° C.

Referring to FIG. 7, the circuit has been trimmed to an output voltage of 4.5V at 25° C. and 75° C. and simulated over the range 0° C. to 100° C. Over the entire 100° C. range of temperature the maximum deviation in output voltage is about 4.5005–4.4999 =0.0006V or ±0.3mV. Expressed in parts per million this is ±0.3mV/4.5V=67ppm and the simulated temperature coefficient (tempCo) is therefore 67ppm/100° C. =0.7ppm/° C.

As will be appreciated from the foregoing description, the above-described problem of precision output voltage trim and temperature coefficient trim interdependence is effectively obviated by the precision voltage reference circuit of the present invention. Additionally, the detailed circuit embodiment maintains the precision output voltage to within ±0.1% after neutron irradiation at a level of $1\times10^{14}$n/cm$^2$ and recovers in much less time from an intense electromagnetic anomaly, such as a gamma radiation event, in comparison with the prior art. This rapid recovery time is due to the absence of the inherently bandwidth limited precision operational amplifier required by the prior art to self-bias the Zener diode reference element.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A voltage reference circuit comprising:

first and second bridge nodes;

a bridge resistor coupled in circuit between said first and second bridge nodes;

a voltage reference device coupled between a first terminal, to which a first supply potential is applied, and said first bridge node;

a first current source coupled between a second terminal, to which a second supply potential is applied, and said first bridge node;

a voltage divider circuit coupled between said first terminal and said bridge second node;

an output terminal coupled to said voltage divider circuit, and from which an output voltage is derived as a fraction of the voltage at said second bridge node;

a second current source coupled between said second terminal and said second bridge node; and a temperature-compensating current supply circuit coupled to said first and second bridge nodes, and being operative to control the flow of current through said bridge resistor such that there is no current flow through the bridge resistor at a first temperature, and such that there is current flow through said bridge resistor at a second temperature.

2. A voltage reference circuit according to claim 1, wherein the value of said bridge resistor is such that the resulting voltage drop across said bridge resistor at said second temperature causes the voltage derived at said output terminal to be maintained at the same voltage measurable at said output terminal at said first temperature.

3. A voltage reference circuit according to claim wherein said temperature-compensating current supply circuit includes a first temperature-dependent current source is coupled to said first bridge node and a second temperature-dependent current source coupled to said second bridge node.

4. A voltage reference circuit according to claim 3, wherein said first and second temperature-dependent current sources have respective temperature-dependent output current characteristics that are effectively complementary to one another.

5. A voltage reference circuit according to claim 4, wherein said first temperature-dependent current source is operative to supply current in a first direction relative to said first bridge node, and said second temperature-dependent current source is operative to supply current in a second direction relative to said second bridge node, whereby, in response to a variation in the operating temperature of said voltage reference circuit, current flow through said bridge resistor is adjusted by said first and second temperature-dependent current sources, so as to maintain a constant output voltage at said output terminal.

6. A voltage reference circuit according to claim 5, wherein said first temperature-dependent current source comprises a first temperature-dependent current source sub-circuit and a first temperature-dependent current sink sub-circuit coupled in series with each other between said first and second supply terminals, and wherein a series connection of said first temperature-dependent current source sub-circuit and said first temperature-dependent current sink sub-circuit is coupled through a first sense resistor to said first bridge node.

7. A voltage reference circuit according to claim 6, wherein said second temperature-dependent current source comprises a second temperature-dependent current source sub-circuit and a second temperature-dependent current sink sub-circuit coupled in series with each other between the first and second supply terminals, and wherein a series connection of said second temperature-dependent current source sub-circuit and said second temperature-dependent current sink sub-circuit is coupled through a second sense resistor to said second bridge node.

8. A voltage reference circuit according to claim 7, wherein said first temperature-dependent current source sub-circuit has a temperature-coefficient that effectively matches that of said second temperature-dependent current sink sub-circuit.

9. A voltage reference circuit according to claim 8, wherein said first temperature-dependent current sink sub-circuit has a temperature-coefficient that effectively matches that of said second temperature-dependent current source sub-circuit.

10. A voltage reference circuit according to claim 9, wherein the magnitudes of the temperature coefficients of complementary pairs of current source and sink sub-circuits at said first and second bridge nodes are such that changes in their currents with temperature result in a readily measurable voltage drop across said sense resistors, so as to facilitate adjustment of circuit components of said voltage reference circuit during calibration.

11. A voltage reference circuit according to claim 1, wherein said voltage reference device comprises a Zener diode.

12. A Zener diode-referenced, bridge-configured, precision voltage circuit comprising:

a first voltage supply terminal to which a first supply voltage is applied;

a second voltage supply terminal to which a second supply voltage is applied;

first and second bridge nodes;

a bridge resistor connected in circuit between said first and second bridge nodes;

a Zener diode coupled between said first bridge node and said first voltage supply terminal;

a voltage divider circuit, comprised of series-connected resistors, coupled between said first voltage supply terminal and said second bridge node;

an output voltage terminal coupled to a common connection of the series-connected resistors of said voltage divider circuit, so that a precision output voltage is derived as a fraction of the voltage differential between said second bridge node and the potential of said first voltage supply terminal;

a fixed magnitude current source coupled between said first bridge node and said second voltage supply terminal;

an adjustable current source coupled between said second voltage supply terminal and said second bridge node, said adjustable current source supplying a bias current to said voltage divider circuit, so as to establish a prescribed voltage drop thereacross and thereby establish said precision output voltage; and a temperature-compensating current supply circuit coupled to said first and second nodes, and operative to control the flow of current through said bridge resistor, such that there is no current flow through said resistor at a first calibration temperature and such that there is a readily measurable current flow through said bridge resistor at a second, calibration temperature.

13. A voltage reference circuit according to claim 12, wherein the value of said bridge resistor is trimmed after the operating temperature of said voltage reference circuit has been elevated from said first calibration temperature to said second calibration temperature, such that the resulting voltage drop across said bridge resistor at the second calibration temperature causes the voltage derived at said output terminal to be maintained at said precision output same voltage that has been preset at the first calibration temperature.

14. A voltage reference circuit according to claim 12, wherein said temperature-compensating current supply circuit includes a first temperature-dependent current source coupled to said first bridge node, and a second temperature-dependent current source coupled to said second bridge node, and wherein said first and second temperature-dependent current sources have respective temperature-dependent output current characteristics that are effectively complementary to one another, such that current injected by one current source into one of said first and second bridge nodes is sinked from the other of said first and second bridge nodes.

15. A voltage reference circuit according to claim 14, wherein said first temperature-dependent current source is operative to supply current in a first direction relative to said first bridge, and said second temperature-dependent current source is operative to supply current in a second direction relative to said second bridge, whereby, in response to a variation in the operating temperature of the precision voltage circuit, current flow through said bridge resistor is adjusted by said first and second temperature-dependent current sources, so as to maintain a constant output voltage at said output terminal.

16. A voltage reference circuit according to claim 15, wherein said first temperature-dependent current source comprises a first temperature-dependent current source sub-circuit and a first temperature-dependent current sink sub-circuit coupled in series with each other between said first and second voltage supply terminals, and wherein each of said first temperature-dependent current source sub-circuit and said first temperature-dependent current sink sub-circuit is coupled from a node connection thereof through a first sense resistor to said first bridge node.

17. A voltage reference circuit according to claim 16, wherein said second temperature-dependent current source comprises a second temperature-dependent current source sub-circuit and a second temperature-dependent current sink sub-circuit coupled in series between said first and second voltage supply terminals, and wherein each of said second temperature-dependent current source sub-circuit and said second temperature-dependent current sink sub-circuit is coupled at a connected node through a second sense resistor to said second bridge node.

18. A voltage reference circuit according to claim 17, wherein said first temperature-dependent current source sub-circuit has a positive temperature-coefficient that effectively matches a positive temperature-coefficient of said second temperature-dependent current sink sub-circuit, and said first temperature-dependent current sink sub-circuit has a negative temperature-coefficient that effectively matches a negative temperature-coefficient of said second temperature-dependent current source sub-circuit.

19. A method of calibrating a Zener diode-referenced, bridge-configured, precision voltage circuit, said precision voltage circuit including a first voltage supply terminal to which a first supply voltage is applied, a second voltage supply terminal to which a second supply voltage is applied, first and second bridge nodes, a bridge resistor connected in circuit between said first and second bridge nodes, a Zener diode coupled between said first bridge node and said first voltage supply terminal, a voltage divider circuit, comprised of series-connected resistors, coupled between said first voltage supply terminal and said second bridge node, an output voltage terminal coupled to a common connection of the series-connected resistors of said voltage divider circuit, so that a precision output voltage is derived as a fraction of the voltage differential between said second bridge node and the potential of said first voltage supply terminal, a fixed magnitude current source coupled between said first bridge node and said second voltage supply terminal, an adjustable current source coupled between said second voltage supply terminal and said second bridge node, said adjustable current source supplying a bias current to said voltage divider circuit, so as to establish a prescribed voltage drop thereacross and thereby establish said precision output voltage, and a temperature-compensating current supply circuit coupled to said first and second nodes, said method comprising the steps of:

(a) at a first calibration temperature, adjusting parameters of said temperature-compensating current supply circuit, said adjustable current source and said voltage divider circuit, such that such that there is no current flow through said bridge resistor, and such that a prescribed output voltage is derived at said output terminal: and (b) at a second calibration temperature, adjusting the value of said bridge resistor such that there is a voltage drop across said bridge resistor, so that the total voltage drop across the series connection of said bridge resistor and said voltage divider, as referenced to the Zener voltage of said Zener diode, causes the voltage at said output terminal to be maintained at said prescribed voltage.

20. A method according to claim 19, wherein step (b) comprises trimming the value of said bridge resistor after the operating temperature of said voltage reference circuit has been elevated from said first calibration temperature to said second calibration temperature, such that the resulting voltage drop across said bridge resistor at the second calibration temperature causes the voltage derived at said output terminal to be maintained at said precision output same voltage that has been preset at the first calibration temperature.

21. A method to claim 20, wherein said temperature-compensating current supply circuit includes a first temperature-dependent current source coupled to said first bridge node, and a second temperature-dependent current source coupled to said second bridge node, and wherein said first and second temperature-dependent current sources have respective temperature-dependent output current characteristics that are effectively complementary to one another, such that current injected by one current source into one of said first and second bridge nodes is sinked from the other of said first and second bridge nodes, and wherein said first temperature-dependent current source is operative to supply current in a first direction relative to said first bridge, and said second temperature-dependent current source is operative to supply current in a second direction relative to said second bridge, whereby, at said second calibration temperature, the value of said bridge resistor is trimmed to compensate for current flow through said bridge resistor being increased by said first and second temperature-dependent current sources, so as to maintain a constant output voltage at said output terminal.

22. A method according to claim 21, wherein said first temperature-dependent current source comprises a first temperature-dependent current source sub-circuit and a first temperature-dependent current sink sub-circuit coupled in series with each other between said first and second voltage supply terminals, and wherein each of said first temperature-dependent current source sub-circuit and said first temperature-dependent current sink sub-circuit is coupled from a node connection thereof through a first sense resistor to said first bridge node, and wherein said second temperature-dependent current source comprises a second temperature-dependent current source sub-circuit and a second temperature-dependent current sink sub-circuit coupled in series between said first and second voltage supply terminals, and wherein each of said second temperature-dependent current source sub-circuit and said second temperature-dependent current sink sub-circuit is coupled at a connected node through a second sense resistor to said second bridge node.

23. A method according to claim 22, wherein said first temperature-dependent current source sub-circuit has a positive temperature-coefficient that effectively matches a positive temperature-coefficient of said second temperature-dependent current sink sub-circuit, and said first temperature-dependent current sink sub-circuit has a negative temperature-coefficient that effectively matches a negative temperature-coefficient of said second temperature-dependent current source sub-circuit.

* * * * *

UNITED STATES PATENT AND TRADEMARK OFFICE

CERTIFICATE OF CORRECTION

PATENT NO. : 5,300,877
INVENTOR(S) : Bruce J. Tesch
DATED : April 5, 1994

It is certified that error appears in the above-identified patent and that said Letters Patent is hereby corrected as shown below:

Drawings:

Delete Fig. 6, and substitute therefor Fig. 6, as shown on the attached page.

Signed and Sealed this

Fifteenth Day of June, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,300,877

DATED : April 5, 1994

INVENTOR(S) : Tesch, Bruce J.

It is certified that error appears in the above-identified patent and that said Letters Patent is hereby corrected as shown below: Replace Figure 6 with Figure 6 below:

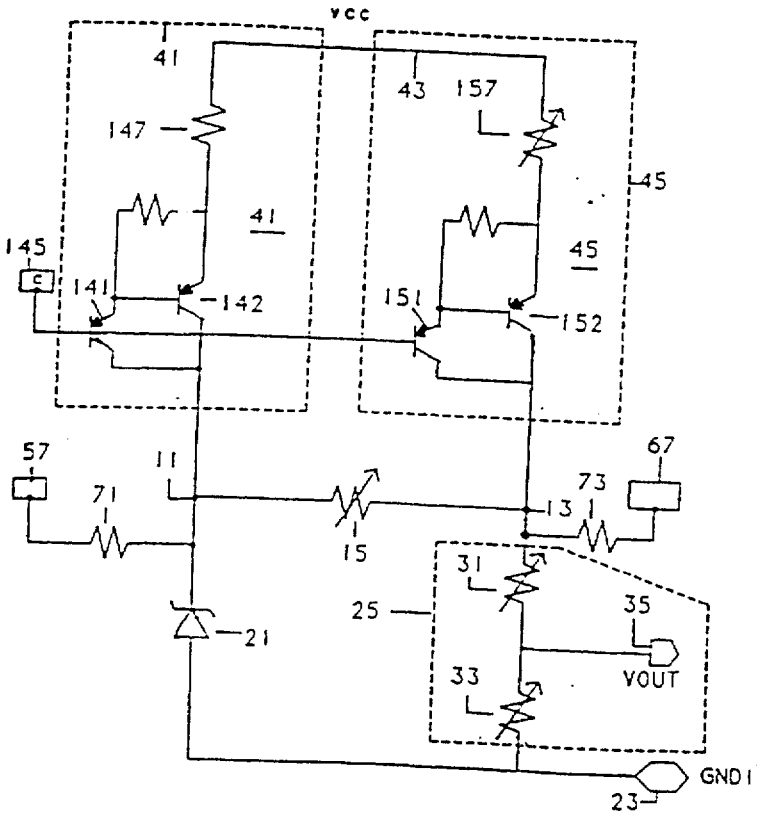

FIG. 6